United States Patent [19]

Tomasi et al.

[11] 4,331,572

[45] May 25, 1982

[54] EFFICIENT SYNTHETIC THICKENER COMPOSITION

[75] Inventors: Thomas G. Tomasi, Foster; Marilyn A. Bell, Cranston, both of R.I.

[73] Assignee: American Hoechst Corporation, Somerville, N.J.

[21] Appl. No.: 85,350

[22] Filed: Oct. 16, 1979

[51] Int. Cl.[3] ..... C08L 33/02

[52] U.S. Cl. ..... 524/238; 8/900; 8/906; 252/316; 252/357; 524/253; 524/251; 524/548

[58] Field of Search ..... 260/17.4 SG, 29.6 N, 260/29.6 PM; 424/81; 8/558, 650, 607, 606, 614, 617, 680, 685, 900, 906; 252/170, 316, 357

[56] References Cited

U.S. PATENT DOCUMENTS

| | | | |
|---|---|---|---|
| 2,488,544 | 11/1949 | Kuhn et al. | 260/9 |
| 2,798,053 | 2/1957 | Brown | 260/2.2 |
| 2,828,180 | 3/1958 | Sertorio | 8/62 |
| 3,138,567 | 6/1964 | Abrams et al. | 260/29.4 |
| 3,458,804 | 7/1969 | Wolf et al. | 106/308 |
| 3,624,019 | 11/1971 | Anderson et al. | 260/29.6 B |
| 3,642,676 | 2/1972 | Saunders et al. | 260/29.6 PM |
| 3,734,873 | 5/1973 | Anderson et al. | 260/29.6 B |
| 3,852,234 | 12/1974 | Venema | 260/29.6 PM |
| 3,861,869 | 1/1975 | Schwindt et al. | 8/62 |
| 3,940,351 | 2/1976 | Schlatzer | 260/17.4 SG |
| 4,052,353 | 10/1977 | Scanley | 260/29.6 PM |
| 4,101,480 | 7/1978 | Ruf | 260/23 AR |
| 4,252,706 | 2/1981 | Phillips | 260/29.6 PM |

OTHER PUBLICATIONS

Carbopol Resins Bulletin No. GC-58, B. F. Goodrich.

Becher, Emulsions: Theory and Practice, pp. 235-238, (1977).

*Primary Examiner*—V. P. Hoke

*Attorney, Agent, or Firm*—Stephan P. Williams

[57] ABSTRACT

This invention relates to a unique, efficient, concentrated synthetic thickener composition comprising a high molecular weight carboxyvinyl polymer, hydrocarbon solvent and cationic surfactant, a thickened concentrate formed by alkaline neutralization of said composition, an aqueous paste (cut clear) formed by dilution of said concentrate, textile print pastes containing said concentrate, and a method of thickening an aqueous system.

20 Claims, No Drawings

EFFICIENT SYNTHETIC THICKENER COMPOSITION

BACKGROUND OF PRIOR ART

It is usual to print textiles with aqueous print pastes comprising pigments, dyestuffs, thickeners and other auxiliaries. The thickener or clear concentrate is used to make up a vehicle for color printing and must impart the proper flow, viscosity and rheological characteristics to the print paste. Heretofore, it has been known in the textile printing art to utilize an alkaline neutralized thickened concentrate comprising polymers or copolymers of carboxylic acids such as acrylic acid, an organic solvent, and an anionic or nonionic surfactant. Such thickened concentrates are generally utilized in the form of an aqueous paste (cut clear) which is formed by let down of the concentrate by addition to water and other auxiliaries where needed. In those cases where the concentrated thickener composition has not been preneutralized with an alkaline agent, the alkaline agent can be added to the water during let down. The alkaline agent usually used is ammonium hydroxide.

A problem encountered with such conventional thickening media is that viscosity tends to break down when electrolytes are introduced into the printing system. This problem is recognized in U.S. Pat. No. 3,940,351. Typical problem electrolytes may be sodium hydrosulfite, zinc sulfoxylate-formaldehyde, potassium citrate, caustic, salt, ammonium sulfate, sodium carbonate, sodium sulfate and others.

Previously only three methods of overcoming this difficulty existed for the printer. He could use select natural thickening agents, he could use solvent emulsions or he could "build up" his low viscosity print paste with additional synthetic thickener. But each of these methods presents additional problems.

Those natural thickening agents which are stable to electrolytes have the disadvantage of high cost and relatively long or tedious makeup. Moreover, their removal from the printed material after printing is essential if fabric with an acceptable quality is to be obtained.

The incorporation of relatively large amounts of a hydrocarbon solvent into synthetic thickener print pastes has occasionally been used to improve electrolyte stability over normal synthetic thickeners (the so-called aqueous thickeners). However, the escalating price of solvent is rapidly making this route unattractive. Moreover, air and water pollution considerations are becoming increasingly more important, not to mention health and safety hazards.

The method building up the viscosity of deteriorated print pastes with subsequent addition of thickener is an equally unattractive alternative due to the extra expense and inconvenience of making the additions.

It is an object of this invention to provide an improved synthetic thickener composition which can form thickened aqueous systems having improved viscosity stability and thickener efficiency in the presence of electrolytes. It is also an object of this invention to provide an improved thickened concentrate (clear concentrate), aqueous paste (cut clear), and textile print paste, and to provide an improved method for thickening aqueous systems.

SUMMARY

We have found that it is possible to form a thickened aqueous system having improved viscosity stability and thickener efficiency in the presence of electrolytes by utilizing a synthetic thickener composition comprising:

(a) about 30 to 70 percent of a hydrocarbon solvent or mixture of solvents having a kauri-butanol value of 25–98;

(b) about 20 to 50 percent of a high molecular weight carboxyvinyl polymer, said polymer having a molecular weight of 750,000 to 1,500,000 and comprising a water-soluble polymer of acrylic acid crosslinked with about 0.5 to 2.0 percent of a polyallyl ether of sucrose having from four to eight allyl groups for each sucrose molecule, and (c) about 3 to 8 percent of a cationic surfactant, which surfactant is derived from a fatty acid amine or diamine having from 12 to 22 carbon atoms, or the base amine of said surfactant.

This composition will form a thickened concentrate (clear concentrate) upon neutralization with aqueous base, which concentrate may be further utilized in an aqueous textile print paste, generally by dilution with water to form a cut clear.

DESCRIPTION

According to the present invention, a unique concentrated synethetic thickener composition is provided which is comprised of high molecular weight carboxyvinyl polymer, solvent and cationic surfactant or base amine thereof. Of course, other auxiliaries may also be incorporated in the composition as required by the intended application.

The high molecular weight carboxyvinyl polymer which constitutes one component of the thickener composition can be described as a water-soluble polymer of acrylic acid crosslinked with about 0.5 to 2.0 percent of a polyallyl ether of sucrose having from four to eight allyl groups for each sucrose molecule. Suitable polymers have molecular weights in the range of 750,000 to 1,500,000, preferably about 1,000,000. These polymers are well-known in the art and can be prepared according to U.S. Pat. No. 2,798,053. They are also available commercially from the B. F. Goodrich Company under the trademark "CARBOPOL". CARBOPOL 820 is preferred. (CARBOPOL 820 has a molecular weight of about 1,000,000, a bulk density of about 13 pounds per cubic foot, a specific gravity of 1.41, an equilibrium moisture content of 8% at room temperature and 50% relative humidity, and a pH of 3 as a 1% aqueous solution.) The polymer component should comprise about 20 to 50 percent of the concentrated thickener composition, preferably about 30 to 40 percent, and most preferably about 35 percent.

Solvents which may be utilized in the thickener composition of the present invention are any of those volatile organic solvents which are ordinarily employed in conventional thickener compositions and generally include the aliphatic, cycloaliphatic and aromatic hydrocarbons, and mixtures of these hydrocarbons, particularly those derived from petroleum fractions such as white spirits. These solvents ordinarily have a boiling range between 120° and 220° C. and a kauri-butanol value of 25–98. Examples of suitable solvents are Varsol 18 (Exxon, KB value 35, flash point 108° F.), Amsco Mineral Spirits 75 (Union Oil Co., KB value 32, flash point 104° F.), Cittol 176 (Lovezzola-Ward Co., a blend of the reaction products of esterified unsaturated fatty acids with amino alcohol and phosphoric acid dissolved in petroleum distillates and containing a small amount of alkyl aryl ethoxylated non-ionic surfactant, flash point >110° F.) and dipentene. A mixture of Amsco Mineral Spirits 75 and Cittol 176 is preferred, particulary in a ratio of 1:1 to 1:4. The solvent or mixture of solvents should comprise about 30 to 70 percent of the thickener composition, preferably from 48 to 62 percent, and most preferably about 58 percent. Cationic surfactants which may be utilized in the present composition are those derived from the fatty acid amines and diamines. These surfactants may be straight or branched chain, saturated or unsaturated, and may contain from 12 to 22 carbon atoms. The base amine from which said surfactants are derived may also be utilized. Typical surfactants or their base amines are Flotegam OA (oleyl amine acetate), Adogen 570-S or Genamin TAP 100 (N-tallow propylene diamine) and Adogen 172 (oleyl amine). These surfactants or base amines, and mixtures thereof, should comprise about 3 to 8 percent of the concentrated thickener composition, preferably about 5 to 7 percent, and most preferably about 6.25 percent.

The concentrated thickener composition of the present invention may be utilized as an in situ thickening agent which can be blended with an aqueous system such as a print paste formulation and then thickened by addition of an alkaline material. However, ordinarily the composition is advantageously converted to a neutralized thickened concentrate (clear concentrate) which can be subsequently utilized to thicken aqueous systems, particularly in its diluted form (cut clear).

The thickened concentrate may be prepared by simply neutralizing the concentrated thickener composition with an aqueous alkaline material to provide a pH greater than 6.5, preferably between 6.5 and 10, and most preferably between 6.8 and 7.5. Suitable alkaline materials are the alkali metal and ammonium hydroxides and carbonates. Also suitable are various amines such as the lower alkyl and alkanol amines. Although the choise is not critical, ammonium hydroxide is preferred.

An alternative method for preparing the thickened concentrate entails first mixing the solvent and some of the cationic surfactant, subsequently adding about half of the carboxyvinyl polymer, neutralizing this mixture, and then adding the remaining surfactant and polymer followed by neutralization. This two step neutralization method is preferred over the first method since it avoids the highly viscous mixture obtained in the first method and better mixing can be achieved.

Advantageously, the concentrated thickener composition will comprise about 50 to 90 percent, preferably about 75 to 85 percent of the thickened concentrate. Thus, the thickened concentrate comprises about 15 to 45 percent, preferably 20 to 40 percent, high molecular weight carboxyvinyl polymer, about 15 to 60 percent, preferably 20 to 50 percent, solvent, and about 1.5 to 7.0 percent, preferably 3 to 7 percent, cationic surfactant, with the remainder being aqueous alkaline material.

The thickened concentrate of the present invention is readily employed to thicken any aqueous system. Typically, the thickened concentrate may be utilized to provide the proper viscosity and flow characteristics to a textile print paste. Such a print paste comprises an aqueous dispersion of a colorant, usually in the form of a color concentrate, the thickened concentrate according to the present invention, and other auxiliary ingredients as dictated by the intended application. Ordinarily the print paste contains about 1 to 6 percent, preferably about 2 to 4 percent of the thickened concentrate.

Usually the concentrate is made up into a cut clear prior to incorporation in the print paste. A typical cut clear comprises about 86 to 98 percent water, 0 to 5 percent binder, 0 to 5 percent auxiliaries, and 2 to 4 percent thickened concentrate. Advantageously the cut clear will contain about 0.8 to 0.9 percent carboxyvinyl polymer. A typical print paste comprises 80 to 99.75 percent cut clear, 0.25 to 15 percent color concentrate and 0 to 5 percent auxiliaries.

The thickened concentrate of the present invention may also be utilized in conjunction with other conventional synthetic thickeners to improve the efficiency of those thickeners. In such an application, the thickened concentrate of the present invention should comprise at least 5 percent of the total thickener utilized.

A further use for the thickened concentrate of the present invention is as an additive to print pastes whose viscosities have deteriorated. The viscosity of such print pastes may be built up by addition of small quantities, usually from about 0.25 to about 2 percent, based on the weight of print paste, of thickened concentrate. Such an addition will improve the thickener efficiency of the print paste as well as raise its viscosity, thus reducing the need for further additions of thickener.

Numerous auxiliary ingredients may be incorporated in the print pastes made according to this invention depending on the intended application and the properties desired. These ingredients may also be advantageously incorporated into the thickener composition, thickened concentrate or cut clear, prior to formation of the print paste.

Such other auxiliary ingredients may include natural and synthetic binders, fixing agents, surface-active compounds, hygroscopic agents, plasticizers, softeners, foam-inhibiting agents, cross-linking agents, aminoplast condensates, catalysts, dispersing agents and leveling agents. The binder is usually a copolymer emulsion based on unsaturated carboxylic acid esters, butadiene, styrene, acrylonitrile and smaller amounts of unsaturated carboxylic acids with or without cross-linking agents. Suitable binders include Imperon Binder 8192-A or P-10A (American Hoechst), Rhoplex E-32 or others of the Rhoplex series (Rohm and Haas), and Hycar 1572+45 or others of the Hycar series (B. F. Goodrich).

A particularly advantageous thickener composition, and corresponding thickened concentrate, cut clear and print paste, may be obtained by optionally incorporating into the composition up to 5 percent, preferably 0.25 to 2.0 percent, of a nonionic surfactant. Examples of suitable nonionic surfactants are the condensation products of alkylene oxides, particularly ethylene and propylene oxide, with fatty alcohols, alkylphenols, polyalcohols, and fatty amines, amides, acids or esters. Some commercially available nonionic surfactants include Arkopal N-300 (American Hoechst), Igepal CO-880 (GAF), and Triton X-305 (Rohm and Haas).The first two of these are the condensation product of thirty moles ethylene oxide with one mole nonylphenol, and the latter one is the condensation product of thirty moles ethylene oxide with one mole octylphenol.

In some instances an anionic emulsifier may optionally be used such as sodium lauryl sulfate or ammonium lauryl sulfate.

Textile print pastes which contain the concentrated thickener composition of the present invention may be utilized to apply colorants to any of the common forms of textile material including the natural fibers such as cotton and wool, the synthetic fibers such as polyesters and polyamides, and blends of natural and synthetic fibers. Conventional pad dyeing or printing techniques may be employed.

As stated previously, the thickener composition of the present invention has shown remarkable thickener efficiency and viscosity stability in the presence of electrolytes. Typically, cut clears made from the present composition and having a carboxyvinyl polymer content of 0.8 to 0.9 percent have maintained a minimum viscosity of 7000 cps (Brookfield RVF-100) after addition of 1.5 percent (based on the weight of cut clear) potassium citrate. In comparison, the viscosity of conventional thickeners with the same polymer content generally falls below 3000 cps under the same conditions.

This thickener efficiency and stability enables the present thickener composition to be advantageously used in combination with the traditional problem coloring agents such as the azoics, reactive dyestuffs, acid dyes and disperse dyes.

The invention is illustrated by the following Examples in which the parts and percentages are by weight. Viscosities are measured on a Brookfield RVF-100 Viscometer using spindle #5 at 20 rpm.

EXAMPLE 1

A concentrated thickener composition is prepared by mixing together 39 parts Cittol 176, 22 parts Varsol #2, and 6 parts Adogen 570-S. After stirring for five minutes, 33 parts Carbopol 820 are added and stirred for about thirty minutes until the mixture is uniform.

EXAMPLE 2

A cut clear is prepared from the above thickener composition by combining 93.5 parts water with 3.0 parts latex binder (Imperon 8192 A), then while stirring at high sheer speed in a Greer homogenizer, adding 2.5 parts thickener composition prepared in Example 1, and 1.0 part ammonium hydroxide (28%). The pH is adjusted to 6.8 to 7.5 with ammonium hydroxide if needed and the mixture stirred until maximum viscosity is reached.

The above cut clear is tested for thickener efficiency by checking its viscosity after addition of 1.5 percent potassium citrate, based on the weight of cut clear. The viscosity measured above 7000 cps in all trails which is an acceptable level for print pastes.

EXAMPLE 3

A thickener concentrate (clear concentrate) is prepared as follows

A laboratory mixer is charged with 570 parts Cittol 176, 360 parts Amsco Mineral Spirits 75, and 50 parts Adogen 570-S. After mixing for five minutes, 280 parts Carbopol 820 are added and mixed until uniform. Then 200 parts of ammonium hydroxide (28%) are added at such a rate to maintain a temperature of 55°–60° C. Another 50 parts of Adogen 570-S and 280 parts of Carbopol 820 are added. When mixed to uniformity, 200 parts ammonium hydroxide (28%) are added slowly, while maintaining the temperature at 65° to 75° C. When neutralization is complete, ten parts of Arkopal N-300, a nonionic surfactant, are added.

EXAMPLE 4

In a laboratory mixer, 25.0 parts of Cittol 176, 18.0 parts Varsol #2 and 5.0 parts Adogen 570-S are thoroughly mixed at slow speed. Then 28.0 parts Carbopol 820 are gradually added and stirred an additional thirty minutes. This mixture is neutralized by addition of 23.5 parts ammonium hydroxide (28%) at such a rate that the temperature is maintained at 65° to 70° C. After neutralization, 0.5 parts Arkopal N-300 is added. This composition can be utilized as a thickened concentrate.

A cut clear is prepared from the above concentrate by adding 3 parts thickened concentrate to a mixture of 3 parts binder and 94 parts water while stirring at high sheer speed. Maximum viscosity is reached after stirring for about five minutes and the pH is between 6.8 and 7.5.

This cut clear is tested for thickener efficiency by the addition of 1.5 percent (by weight of cut clear) of potassium citrate. The viscosity of the cut clear is greater than 7000 cps after the addition.

We claim:

1. A thickener composition comprising:

(a) about 30 to 70 percent of a hydrocarbon solvent or mixture of solvents having a kauri-butanol value of 25–98;

(b) about 20 to 50 percent of a high molecular weight carboxyvinyl polymer, said polymer having a molecular weight of 750,000 to 1,500,000 and comprising a water-soluble polymer of acrylic acid cross-linked with about 0.5 to 2.0 percent of a polyallyl ether of sucrose having from four to eight allyl groups for each sucrose molecule; and (c) about 3 to 8 percent of a cationic surfactant, which surfactant is derived from a fatty acid amine or diamine having from 12 to 22 carbon atoms, or the base amine of said surfactant.

2. A thickener composition according to claim 1 wherein said hydrocarbon solvent comprises about 48 to 62 percent of said composition, said carboxyvinyl polymer comprises about 30 to 40 percent of said composition, and said cationic surfactant or base amine thereof comprises about 5 to 7 percent of said composition.

3. A neutralized thickened concentrate composition comprising the composition of claim 1 and an amount of aqueous alkaline solution sufficient to provide a pH of concentrate of 6.5 to 10.

4. A neutralized thickened concentrate composition according to claim 3 wherein said hydrocarbon solvent comprises about 20 to 50 percent of said concentrate, said carboxyvinyl polymer comprises about 20 to 40 percent of said concentrate, said cationic surfactant or base amine thereof comprises about 3 to 7 percent of said concentrate, and said aqueous alkaline solution comprises the remainder of said concentrate.

5. A neutralized thickened concentrate composition according to claim 4 wherein said hydrocarbon solvent comprises about 40 to 50 percent of said concentrate, said carboxyvinyl polymer comprises about 20 to 30 percent of said concentrate, said cationic surfactant or base amine thereof comprises about 4 to 6 percent of said concentrate, and said aqueous alkaline solution comprises about 20 to 30 percent of said concentrate.

6. A neutralized thickened concentrate composition according to claim 5 having a pH of from 6.8 to 7.5.

7. A neutralized thickened concentrate composition according to claim 6 wherein said aqueous alkaline solution is an aqueous solution of alkali metal hydroxide, alkali metal carbonate, ammonium hydroxide or ammonium carbonate.

8. A neutralized thickened concentrate composition according to claim 7 wherein said hydrocarbon solvent comprises about 46 percent of said concentrate, said carboxyvinyl polymer comprises about 28 percent of said concentrate, said cationic surfactant or base amine thereof comprises about 5 percent of said concentrate, and said aqueous alkaline solution comprises about 20 percent of said concentrate.

9. A neutralized thickened concentrate composition according to claim 8 wherein said aqueous alkaline solution is ammonium hydroxide.

10. A cut clear composition comprising water and about 1 to 5 percent by weight of cut clear of neutralized thickened concentrate of claim 4.

11. A cut clear composition according to claim 10 wherein said hydrocarbon solvent comprises about 1.05 to 1.35% of said cut clear, said carboxyvinyl polymer comprises about 0.75 to 1.05 percent of said cut clear, and said cationic surfactant or base amine thereof comprises about 0.12 to 0.18 percent of said cut clear, and wherein said cut clear has a pH of 6.8 to 7.5.

12. A cut clear composition according to claim 11 wherein said carboxyvinyl polymer comprises about 0.8 to 0.9 percent of said cut clear.

13. A cut clear composition according to claim 11 which additionally comprises up to 0.20 percent latex binder.

14. A print paste composition comprising:

(a) 80 to 99.75 percent of cut clear according to claim 11;

(b) 0.25 to 15 percent color concentrate, and (c) 0 to 5 percent auxiliary ingredients.

15. A composition according to claim 1, 2, 3, 4, 5, 6, 7, 8, 9, 10, 11, 12, 13, or 14 wherein said carboxyvinyl polymer is Carbopol 820.

16. A composition according to claim 15 which additionally comprises up to 18 percent by weight of carboxyvinyl polymer of a non-ionic surfactant.

17. A composition according to claim 15 wherein said cationic surfactant or base amine thereof is selected from the group consisting of oleyl amine acetate, N-tallow propylene diamine and oleyl amine.

18. A composition according to claim 17 wherein said hydrocarbon solvent is selected from the group consisting of Varsol #18, Cittol 176, Amsco Mineral Spirits 75, dipentene, and mixtures thereof.

19. A method of thickening aqueous systems which comprises adding to said system from 0.25 to 10 percent of the thickener composition of claim 2 and neutralizing said system with aqueous alkaline solution.

20. A method of thickening aqueous systems which comprises adding to said system from 0.25 to 10 percent of the thickened concentrate of claim 5.

* * * * *